United States Patent [19]

Brown et al.

[11] 3,977,612

[45] Aug. 31, 1976

[54] GRINDING APPARATUSES

[75] Inventors: Lester Brown, Flushing; Paul M. Moskowitz, Brooklyn, both of N.Y.

[73] Assignee: Salton, Inc., Bronx, N.Y.

[22] Filed: June 9, 1975

[21] Appl. No.: 585,379

[52] U.S. Cl. ..... 241/254; 241/257 R; 241/259.1

[51] Int. Cl.[2] ..... B02C 7/10; B02C 7/14

[58] Field of Search ..... 241/244, 245, 248, 259, 241/259.1, 254, 257 R

[56] References Cited

UNITED STATES PATENTS

| | | | |
|---|---|---|---|
| 2,678,170 | 5/1954 | Lee | 241/257 R X |
| 3,429,350 | 2/1969 | Otto | 241/248 X |
| 3,482,790 | 12/1969 | Boster | 241/259.1 |
| 3,552,663 | 1/1971 | Royals | 241/257 R |
| 3,880,367 | 4/1975 | Grover | 241/248 |

*Primary Examiner*—Roy Lake
*Assistant Examiner*—Howard N. Goldberg
*Attorney, Agent, or Firm*—Edward D. O'Brian

[57] ABSTRACT

A grinding apparatus intended for domestic use in making nut butter from nuts such as peanuts can be constructed so as to utilize a housing containing a motor. The motor shaft is used to support a lower assembly and to drive a lower grinding disk forming a part of this assembly. An upper assembly is movably mounted on the lower assembly in such a manner that the relative position of an upper grinding disk relative to the lower grinding disk can be adjusted or varied in order to obtain what may be referred to as a "smoothly ground" product or what may be referred to as a "chunky ground" product consisting of particles ground to various different sizes. An actuator is provided for moving the upper assembly so as to obtain either of these types of products. A hopper structure is used to convey nuts or other material to be ground through the upper assembly to a space between the two grinding disks. This hopper and the upper assembly are constructed so as to accomodate the relative movement of the upper assembly without the possibility of the material to be ground being conveyed by the hopper to other than the interior of the upper assembly.

18 Claims, 7 Drawing Figures

GRINDING APPARATUSES

BACKGROUND OF THE INVENTION

This specification pertains to new and improved grinding apparatuses. It is primarily directed to grinding equipment intended for domestic or home type use in grinding nuts such as peanuts into nut butters of different consistencies. It is considered, however, that the grinding equipment herein disclosed is capable of being used in grinding other materials than nuts.

The field of grinding is of course extremely old. Mankind has been utilizing grinding equipment of various types since prior to the advent of civilization. As society has changed grinding equipment has tended to become increasingly sophisticated. A large number of different types of specialized grinding apparatuses have been developed for various types of specialized uses. It is considered that there has been an increasing tendency for such equipment to be specifically designed for certain comparatively large commercial uses. Practically all ground foodstuffs are now commercially prepared using such comparatively large equipment.

There are, however, a few exceptions to this. On occasion some foodstuffs such as meats, spices, coffee and the like are domestically ground prior to use utilizing specialized home type grinding equipment. Frequently the individual who grinds such materials domestically considers that a freshly ground product prepared in the home is more desirable than a commercially ground product which is stored for an indeterminable period after being ground prior to being consumed. The reasons why individuals hold such beliefs are unimportant to a consideration of the present invention. It is considered, however, important to note that in general a piece of "home" grinding equipment is primarily intended to be used and is primarily useful in grinding a single type of material. This can be illustrated by noting that a common domestic meat grinder is normally constructed differently from a domestic coffee mill and that both of these types of grinders are normally significantly different from many spice grinders such as a domestic nutmeg grinder.

It is not considered that any of these home type grinding apparatuses are particularly suitable for use in grinding nuts so as to make nut butters because of their construction and because of the physical characteristics of various types of nut butters. The reasons for this are varied and complex. An understanding of the present invention is not believed to require a detailed understanding and/or review of these reasons. However, it is noted that frequently the user of a nut butter will desire a freshly ground product having either a smooth type consistency and/or a chunky type consistency in which particles of nuts are dispersed in a smoothly ground product.

SUMMARY OF THE INVENTION

An objective of the present invention is to provide new and improved grinding apparatuses. More specifically the invention is intended to provide grinding equipment which can be easily and conveniently utilized in domestic and home type environments for grinding nuts into nut butters of various different consistencies. Another objective of the invention is to provide grinders as indicated which may be easily and conveniently utilized and which may be constructed at a comparatively nominal cost. A further objective of the invention is to provide grinding apparatuses as herein indicated which may be easily disassembled and cleaned as required.

A grinding apparatus in accordance with this invention includes two generally circular grinding disks, each of which has a peripheral grinding surface in its center region, these disks being located so that these grinding surfaces are adjacent to one another, these center regions being shaped so as to define an internal space generally between these disks, inlet means extending through a first of these disks for introducing material to be ground in this space and drive means for rotating at least one of the disks relative to the other of the disks and includes the improvement which comprises: mounting means for mounting the first of the disks relative to a second of the disks so that the relative positions of the grinding surfaces can be changed between a first position in which the surfaces on both of the disks are parallel and in which the surfaces on the disk are concentrically located about the axis of rotation of the one of the disks, actuating means for moving the first disk between the first and second positions and for holding the disks in these positions, and actuating means being operatively connected to the first disk, and hopper means for containing material to be ground and for conveying such material into the space between the disk located so as to be in communication with the inlet means, this hopper means fitting with respect to the first disk so as to accomodate the first disk being moved between the first and second positions without such material passing other than from the hopper means into the space.

BRIEF DESCRIPTION OF THE DRAWINGS

Unfortunately a summary such as the preceding is somewhat limited in the amount of information it can convey. Further details of grinding apparatuses in accordance with this invention are best more fully indicated with reference to the accompanying drawings in which.

Figure 1:
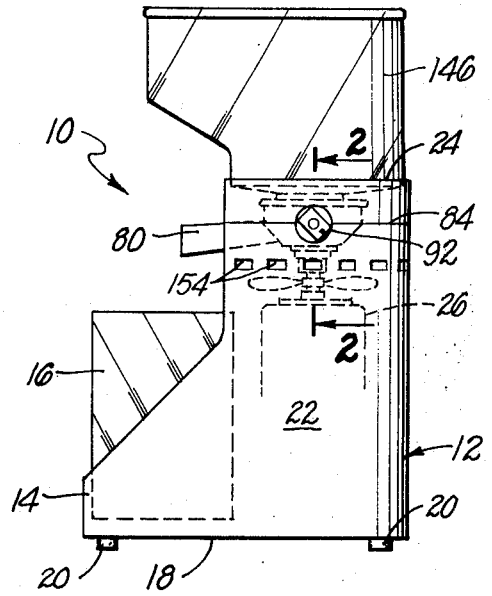
FIG. 1 is a side elevational view of a presently preferred embodiment or form of a grinding apparatus of this invention.
Figure 3:
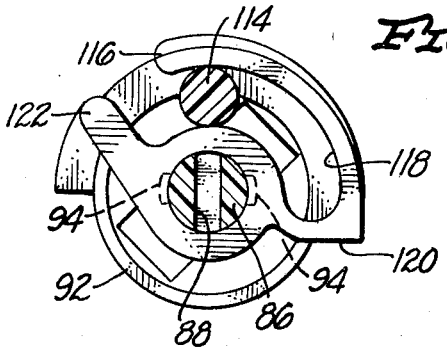
FIG. 3 is a partial cross-sectional view taken at line 3—3 of FIG. 2.
Figure 2:
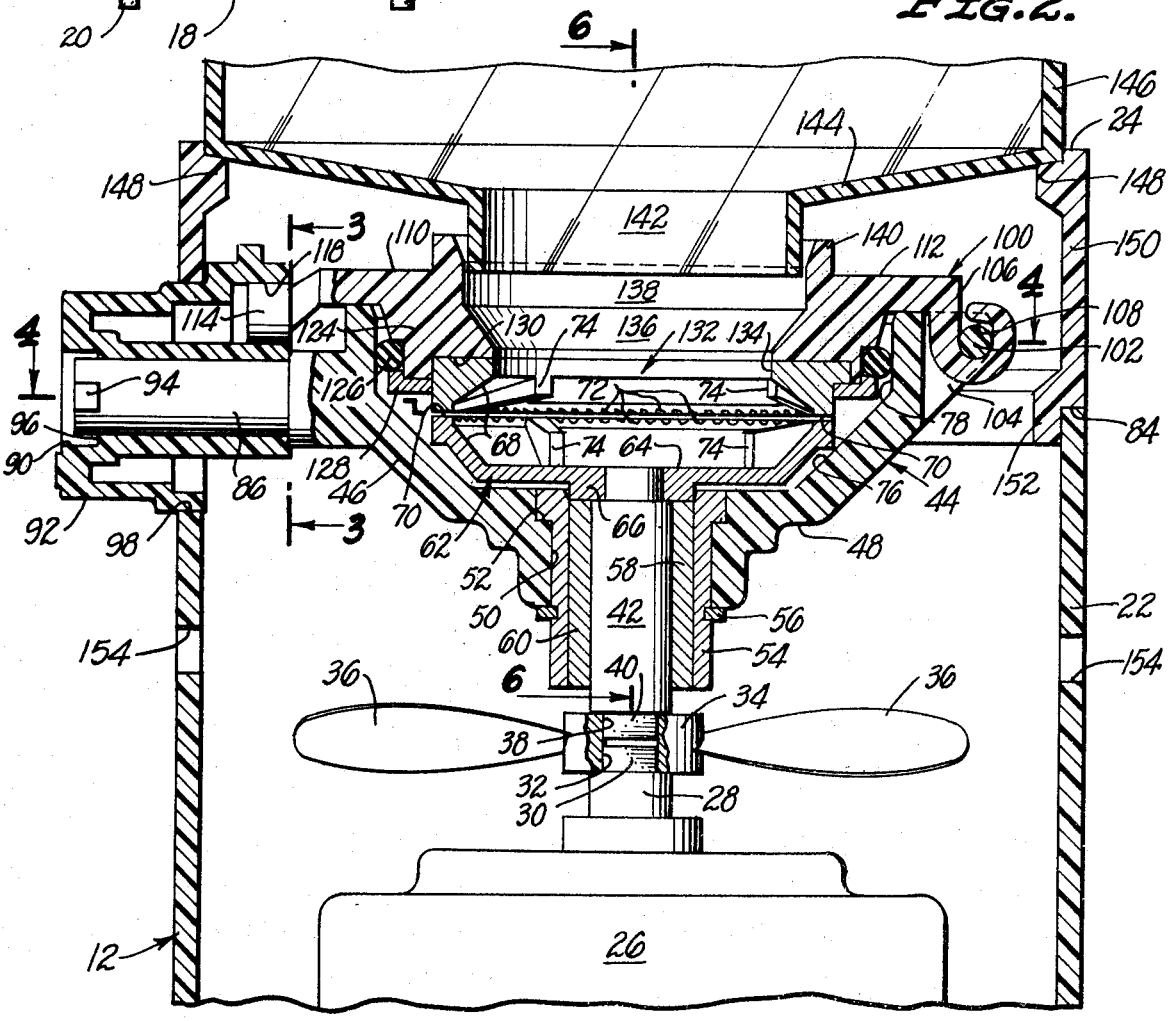
FIG. 2 is a partial cross-sectional view at an enlarged scale taken at line 2—2 of FIG. 1.
Figure 4:
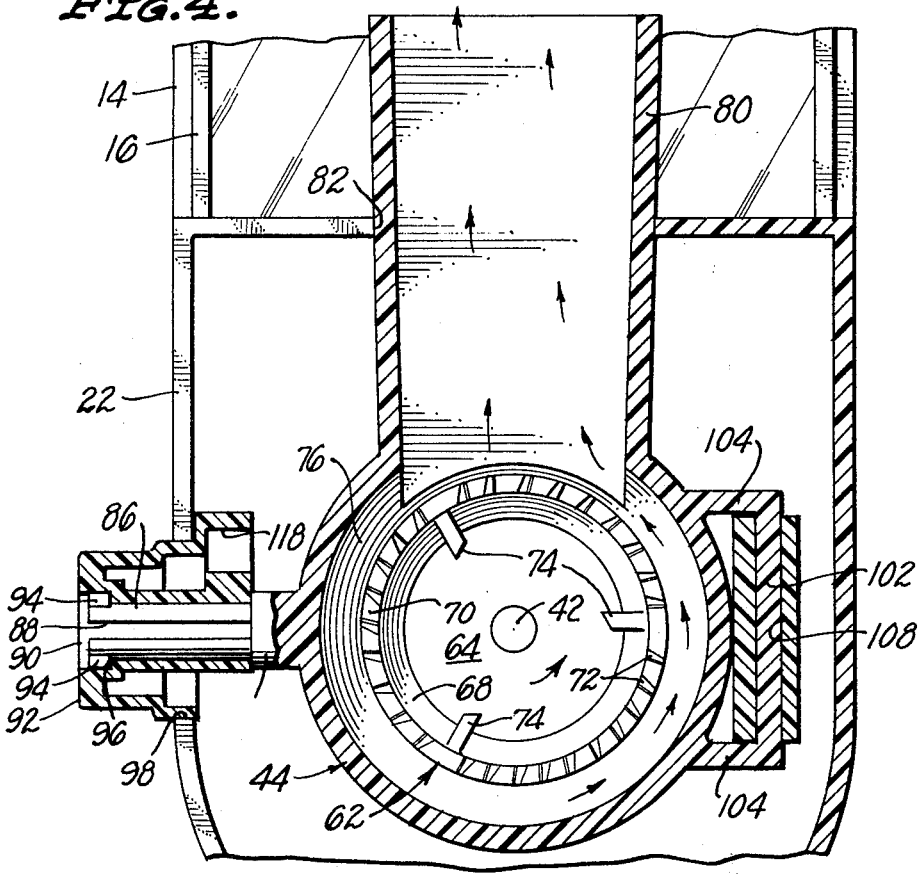
FIG. 4 is a partial cross-sectional view taken at line 4—4 of FIG. 2.
Figure 5:
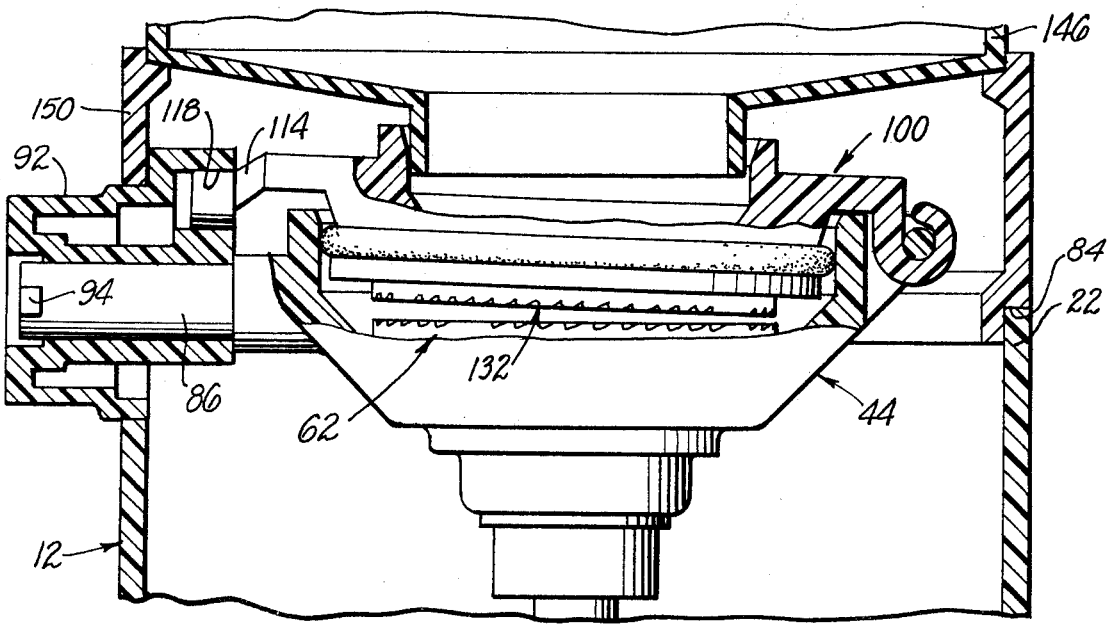
FIG. 5 is a cross-sectional view corresponding to FIG. 2 in which various parts are wholly or partially shown in elevation; and in which certain parts are oriented differently than in the preceding views in order to obtain a different type of grinding effect.
Figure 6:
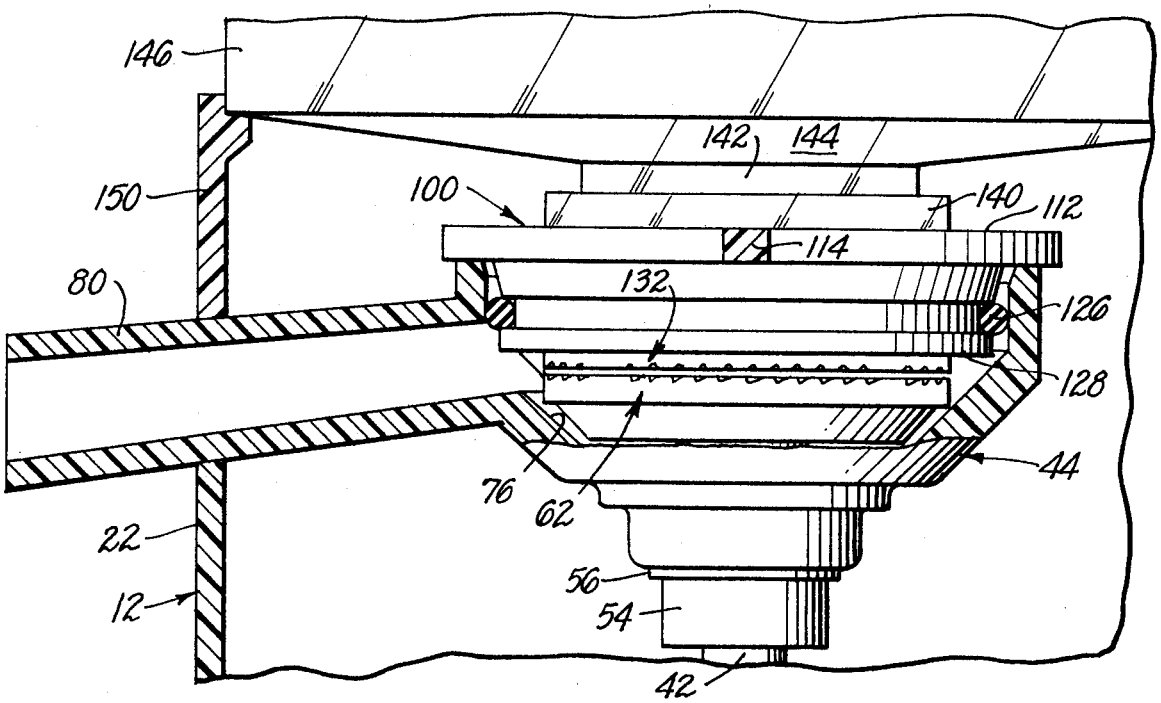
FIG. 6 is a partial cross-sectional view taken at line 6—6 of FIG. 2 illustrating the spout orientation.

The specific grinding apparatuses illustrated in the drawings are specific structures which utilize operative concepts or principles as are set forth and/or defined in the appended claims. Through the use or exercise of routine engineering skill these concepts and/or principles may be easily utilized in a number of differently appearing and differently constructed grinding apparatuses.

DETAILED DESCRIPTION

In FIGS. 1 to 7 of the drawings these is shown a grinding apparatus 10 in accordance with this invention. This apparatus 10 includes a housing 12 provided with a side holder 14 which is adapted to carry a removable receptacle 16 for nut butter or the like. This housing 12 has a perforate bottom 18 which is adapted to be supported on a table surface or the equivalent by small rubber legs 20. This housing 12 also includes a peripheral, continuous vertically oriented wall 22 having an upper edge 24.

A conventional electric motor 26 having a drive shaft 28 is conventionally mounted in the housing 12 within this wall 22 in such a manner that the shaft 28 is vertically oriented within the interior of the housing 12. This shaft 28 is provided with a non-round end 30 which fits within a correspondingly shaped hole 32 in a hub 34. This hub 34 may conveniently be formed so as to carry fan blades 36 if a motor 26 is used which requires cooling so as to insure its proper operation. The hub 34 also carries another non-round hole 38 which is adapted to receive a correspondingly shaped non-round end 40 on a further shaft 42.

This shaft 42 forms a part of what may be regarded as a lower assembly 44. This assembly 44 includes a more or less cup-shaped retainer or housing 46 having a base 48. This base 48 is provided with a centrally located non-round opening 50 having an internal stepped shoulder 52. A bearing retainer 54 fits closely within this opening 50 and is held in place on the base 48 by means of a conventional snap ring 56. This retainer 54 has a cylindrical interior 58 within which there is secured a conventional bearing 60. The bearing 60 is preferably secured in place by being press fitted within the retainer 54, but it may also be secured in place in other conventional manners. This bearing 60 carries the shaft 42 in such a manner as to rotatably support a lower cutting disk 62 within the housing 46.

This disk 62 is provided with a depressed central region 64 having a dependent boss 66 which rides against the bearing 60. This disk 62 is also provided with a conical wall 68 leading from the central region 64 to a flat peripheral grinding surface 70 which is preferably provided with grinding grooves 72. Both the wall 68 and the grinding surface 70 are concentric about the axis of the shaft 42. Preferably projections 74 are symmetrically located on the wall 68 so as to extend from this wall 68 toward the central region 64 in order to control material movement and to achieve a chopping action as the disk 62 is rotated through the operation of the motor 26.

This lower assembly 44 also includes an interior sloping wall 76 leading outwardly from the base 68 to a short cylindrical wall 78. A discharge spout 80 is formed integrally with the housing 46 so as to lead from the interior of this housing 46 at about the location where the walls 76 and 78 intersect one another. This spout 80 extends through a notch 82 at a break 84 in the wall 22 to immediately above the normal location of the receptacle 16.

The housing 46 also carries an external stabilizing projection 86 having a slit 88 extending along its length. This projection 86 is adapted to be temporarily deformed so as to fit within a cyindrical hole 90 in an adjusting knob 92 so that bumps 94 on the projection 86 will lock behind a shoulder 96 in the hole 90 in such a manner as to secure the knob 92 to the housing 46.

This knob 92 normally fits within another notch 98 in the wall 22 so as to extend to the exterior of the housing 12 in such a manner that it can be manipulated in order to regulate the position of an upper assembly 100 relative to the lower assembly 44.

A shaft 102 is carried by a pair of ears 104 on the exterior of the housing 46 and is used to support the upper assembly 100 on the lower assembly 40. This upper assembly 100 carries an end 106 having an opening 108 which fits around this shaft 102 in such a manner that the entire body 110 of this assembly 100 can be pivoted through a comparatively small angle. This body 110 also includes a more or less plate-like top 112 which carries a headed arm 114.

This arm 114 is adapted to fit within an opening 116 leading to a cam groove 118 formed in a hook-like extension 120 on the adjusting knob 92. This opening 116 is in part defined by a stop wall 122 which is also an extension on the adjusting knob 92. With this structure the arm 114 may be regarded as a cam follower since it rides within the groove 118 as the knob 92 is turned in such a manner as to transmit motion to the body 110 so as to pivot the upper assembly 100.

This body 110 further includes a more or less plug-type lower extension 124 fitting within the cylindrical wall 78. During the operation of the apparatus 10 a seal is formed between this extension 124 and the wall 78 through the use of a conventional elastomeric sealing ring 126. This ring 126 is normallly held in place relative to the extension 124 though the use of a conventional ring-like retainer 128 which is secured to the extension 124. This extension 124 also is provided with an internal, downwardly facing, cylindrical cavity 130 which carries an upper grinding disk 132.

This disk 132 is quite similar to the disk 62 in that in includes a conical wall 68, a grinding surface 70, grinding teeth 72 and projections 74, all of which correspond to such parts on the disk 62 and all of which are preferably of approximately the same dimension of such parts on the disk 62. However, the disk 132 differs from the disk 62 in that it is directly connected to the extension 124 in a conventional manner so that it will not move relative to the body 110 whereas the disk 62 is rotatably mounted as previously described.

The disk 132 also differs from the disk 62 in that it includes a centrally located opening 134 which leads to a conical wall 136 in the body 110. This wall 136 is upwardly and outwardly directed so as to lead to a cylindrical cavity 138 in the top 112. This cavity 138 is surrounded by a small upwardly directed, cylindrical flange 140 on the top 112 which in effect constitutes an extension of the cavity 138.

This structure is designed so that a cylindrical extension 142 leading from a generally conical bottom 144 of a hoper 146 will fit closely within the cavity 138 in such a manner as to accommodate the limited movement of the upper assembly 100 as the adjustment knob 92 is turned. The extension 142 should extend well into this cavity 138 so that there is substantially no danger of material moving from the hopper 146 into other than the space (not separately numbered) generally between the disks 62 and 132 as the apparatus 10 is utilized.

This hopper 146 may be supported in the manner shown upon clip-like projections 148 so as to extend upwardly from a small band 150 forming a part of the wall 22. This band 150 preferably includes an internal flange 152 fitting within the wall 22 in order to stabilize it into position. If the hopper 146 was supported by the upper assembly 100 it is considered that the weight of the hopper and contents might be detrimental to the operation of the apparatus 10. It is noted that the hopper serves as a cover for the housing 12. Air holes 154 may be located in the extension 142 or in a lower part of the wall 22.

When the apparatus 10 is to be used, material (not shown) to be ground using this apparatus 10 will be located within the hopper 146. Such material will move by gravity and to a degree as the result of vibration caused by the operation of the motor 26 downwardly though the extension 142 through the cavity 138 past the wall 136 into the space (not separately numbered) generally between the disks 62 and 132. This will cause the material to be located where, as the disk 62 is rotated, such material will be directed to generally between the surfaces 70 by centrifugal force and the operation of the projections 74.

These projections 74 will also accomplish a degree of comminution as the result of the rotation of the disk 72. As a consequence of this mode of operation ground material will move past the surfaces 70 where such material will be further ground and will move outwardly from the disks 62 and 132 into the housing 46 of the lower assembly 44. As material accumulates within this housing 46 the pressure of additional material being propelled outwardly as a result of the operation of the disk 62 will force the accumulated material within the housing 46 outwardly through the spout 80.

As this disk 62 turns, rotation of the lower assembly 44 will be prevented because of the engagement of the spout 80 within the notch 82 and because of engagement of the adjusting knob 92 within the notch 98. It is noted that a lever arm type of advantage minimizing the force necessary to stabilize the lower assembly 44 is achieved with this structure because of the distances from the axis of rotation of the shaft 42 to the wall 22.

The apparatus 10 can be utilized as it is operated as indicated in the preceding so as to obtain what may be regarded as a "smooth" or uniformly ground product by positioning the adjustment knob 92 so that the surfaces 70 of the disks 62 and 132 are parallel to one another and are concentric with one another about the axis of rotation of the shaft 42. Through rotation of the adjustment knob 92 the upper assembly 100 may be rotated so that the axis of the disk 132 is canted at a slight angle to the axis of the disk 62. This will, of course, vary the spacing between the surfaces 70 so that these surfaces are closely adjacent to one another and are spaced apart a maximum amount at diagrammatically opposed points across the interior of the space (not separately numbered) between the disks 62 and 132.

This is considered advantageous when it is desired to produce a product which contains "chunks" or small bodies or particles of partially comminuted material along with more finely ground product. This feature enables the apparatus 10 to be utilized in achieving a "chunky" type product such as a product known as "chunky peanut butter". The apparatus 10 can, of course, be utilized in either producing uniformly ground products or products which are not uniformly ground from many materials, such as virtually any type of common nut or the like.

Figure 7:
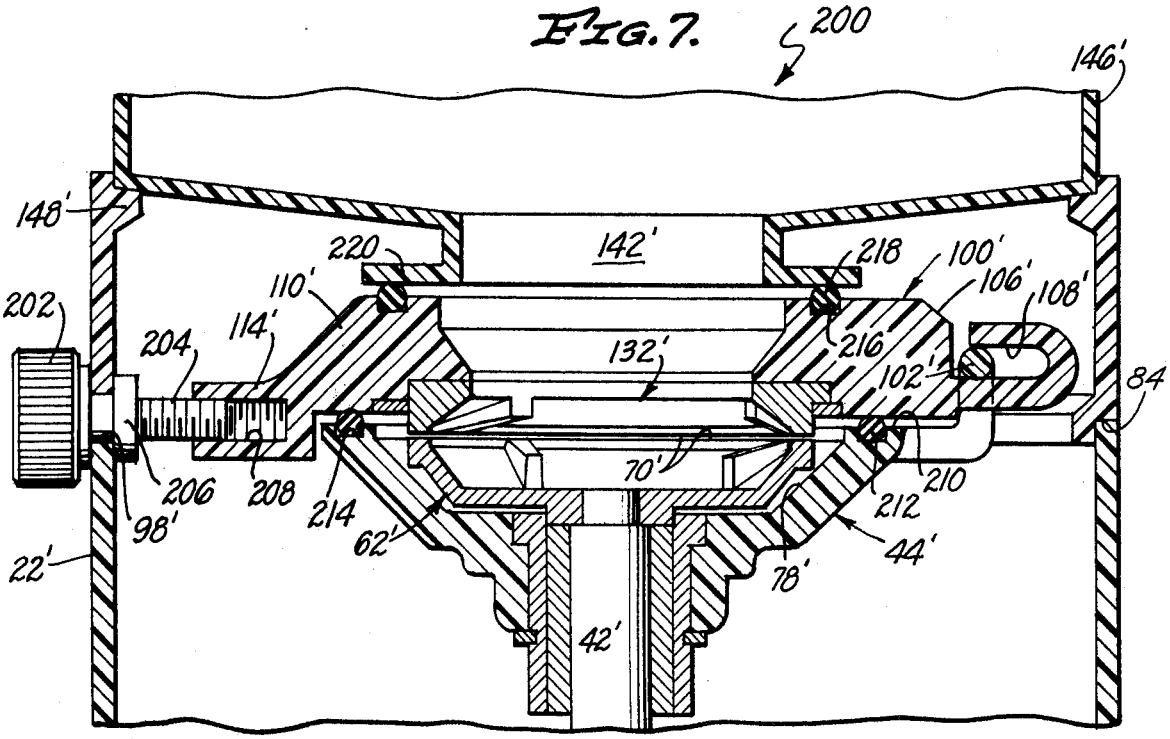
FIG. 7 is a cross-sectional view corresponding to FIG. 2 of a modified grinding apparatus in accordance with this invention.

In FIG. 7 of the drawing there is shown a modified grinding apparatus 200 in accordance with this invention which is extremely similar to the previously described grinding apparatus 10. For convenience of explanation and in the interest of brevity those parts of the grinding apparatus 10 which are the same or nearly the same as corresponding parts of the apparatus 10 are not separately described herein and are indicated where necessary for explanatory purposes in the remainder of this specification and are indicated in the drawings by the primes of the numerals previously used to designate such parts.

This grinding apparatus 200 is quite similar to the apparatus 10 but can be adjusted in a different manner than the apparatus 10 in order to vary the consistency of a ground product. In the apparatus 10 such variation is achieved through the movement of the upper grinding disk 132 relative to the lower grinding disk 62 so as to vary the relative positions of these disks between a position in which they are concentric about a common axis and a position in which their axes are located at an angle to one another. In the apparatus 200 the two grinding disks 62' and 132' are used in such a manner that the relative positions of these disks can also be varied, but in a different manner in that such variation involves moving one of these disks relative to the other of the disks so that their axes are either aligned or parallel depending upon their position.

This is best explained with reference to the apparatus 200 as illustrated in FIG. 7 of the drawings. The upper assembly 100' used in this apparatus 200 is mounted upon the lower assembly 44' though the use of an end 106' having an opening 108' fitting around a shaft 102' as previously described. This opening 108' is of an elongated character so as to accommodate linear movement of the upper assembly 100'. Such movement is achieved through the use of a knurled knob 202 serving as a head upon a threaded shaft 204. This knob 202 replaces the adjusting knob 92 previously described and is mounted in place in the notch 98' in the same manner in which the knob 92 is mounted. This shaft 204 is held against linear movement by the knob 202 fitting against one side of the wall 22' and by a small collar 206 fitting against the other side of this wall 22'. The shaft 204 is threaded into a threaded hole 208 in an arm 114' corresponding to, but slightly different from, the previously described arm 114.

With the apparatus 200 the cylindrical wall 78' of the housing 46' terminates in a flat top 210 extending transverse to the axis of the disk 62'. A conventional elastomeric O-ring seal 212 is located within a groove 214 in this top 210. This groove 214 obviously extends completely around the top 210. This seal 212 at all times bears against the body 110' of the upper assembly 100'. In the apparatus 200 another circular groove 216 is provided on the top 112' for the purpose of holding another similar seal 218 so that this seal 218 will at all times bear against a flange 220 carried by the extension 142' of the hopper 146'. Normally the weight of the hopper 146' will be adequate to hold this hopper 146' downward to a sufficient extent so that the seal 218 will be operative as a seal. If desired, however, the projections 148 may be replaced by other conventional mounting structures (not shown) which will bias the hopper 146' downwardly. It will be realized that both the flange 220 and the top 112' extend transverse to the axis of the upper grinding disk 132'.

The operation of the grinding apparatus 200 is essentially quite similar to the operation of the apparatus 10. In order to obtain a variation in the grinding produced with the apparatus 200 the knob 202 is turned so as to move the upper grinding disk 132' from a position in which the axis of this disk 132' is aligned with the axis of rotation of the disk 62' in which a "smooth grind" is achieved to a position in which the axes of these disks 62' and 132' are offset with respect to one another. In the first of these positions the grinding surfaces 70' are directly opposite on another and are located concentrically about the axes of these disks 62' and 132'. In the second of these positions the disks are offset with respect to one another so that the amount of overlap between the grinding surfaces 70' is varied so that at two diametrically opposite points across the axis of either of these two disks there is very little overlap while at two other diametrically opposite points along a line drawn at a right angle to the line between the first mentioned two points the amount of overlap is substantially the same as is achieved in the first of the positions.

It is quite important that both of the apparatuses 10 and 200 are constructed in such a manner that these apparatuses may be readily disassembled by lifting off and adjusting various parts in what are considered obvious ways. This is considered to facilitate cleaning of the operative parts of the apparatuses described each time these apparatuses have been used for their intended purpose. Preferably the various parts of the apparatuses 10 and 200 are constructed of known material which will not be harmed or damaged if they are in so-called dishwashing appliances. This is considered to improve the acceptability of these apparatuses 10 and 200 for home use.

It is considered that these apparatuses 10 and 200 are desirable in that even an untrained individual will be able to utilize these apparatuses without difficulty in producing freshly ground nut butters and other similar products of a consistency as may be desired. The simplicity and effectiveness of these apparatuses 10 and 200 are considered to make them relatively inexpensive to manufacture and convenient to use.

We claim:

1. A grinding apparatus which includes two generally circular grinding disks, each of said disks having a peripheral grinding surface and a center region, said disks being located so that said grinding surfaces are adjacent to one another, said center regions being shaped so as to define an internal space generally between said grinding disks, inlet means extending through a first of said disks for introducing material to be ground into said space and drive means for rotating at least one of said disks relative to the other of said disks in which the improvement comprises:

mounting means for mounting said first disk relative to the second of said disks so that the relative positions of said grinding surfaces can be changed between a first position in which said grinding surfaces on both of said disks are parallel to one another and in which said grinding surfaces on said disks are both concentrically located about an axis of rotation around which said one of said disks is rotated by said drive means, and a second position in which the relative positions of said grinding disks are different from said first position, actuating means for moving said first disk on said mounting means between said first and said second positions and for holding said disks in said positions, said actuating means being operatively connected to said first disk, and hopper means for containing material to be ground and for conveying such material into said space located so as to be in communication with said inlet means, said hopper means fitting with respect to said first disk so as to accommodate said first disk being moved between said first and said second positions without such material passing other than from said hopper means into said space.

2. A grinding apparatus as claimed in claim 1 wherein:

said actuating means comprise cam means consisting of a cam and a cam follower, one of said parts of said cam means being located on said first disk, the other of said parts being located so as to be movable with respect to the one of said parts of said cam means located on said first disk.

3. A grinding apparatus as claimed in claim 1 wherein:

said mounting means comprises hinge means connecting said disks, said hinge means permitting said disks to be located in a second position in which the axes of said disks are at an angle to one another.

4. A grinding apparatus as claimed in claim 3 wherein:

said hopper means includes an outlet extension, said inlet means comprises a centrally located opening extending through said first disk, said extension fitting closely within said opening so that material will only move from said hopper means through said extension and said opening into said space, said extension fitting within said opening so as to permit movement of said first disk between said first and second positions.

5. A grinding apparatus as claimed in claim 3 including:

housing means for receiving ground material located around the exteriors of said first and second disks, a spout for conveying ground material from said housing means connected to the interior of said housing means so as to extend outwardly therefrom, seal means connecting said disks and said housing means so as to close off the interior of said housing means around the peripheries of said disks, said seal means being operative in all relative positions of said disks.

6. A grinding apparatus as claimed in claim 1 wherein:

said actuating means comprise cam means consisting of a cam and a cam follower, one of said parts of said cam means being located on said first disk, the other of said parts being located so as to be movable with respect to the one of said parts of said cam means located on said first disk, said mounting means comprises hinge means connecting said disks, said hinge means permitting said disks to be located in a second position in which the axes of said disks are at an angle to one another, said hopper means includes an outlet extension, said inlet means comprises a centrally located opening extending through said first disk, said extension fitting closely within said opening so that material will only move from said hopper means through said extension and said opening into said space, said extension fitting within said opening so as to permit movement of said first disk between said first and second positions, and including housing means for receiving ground material located around the exteriors of said first and second disks, a spout for conveying ground material from said housing means connected to the interior of said housing means so as to extend outwardly therefrom, seal means connecting said disks and said housing means so as to close off the interior of said housing means around the peripheries of said disks, said seal means being operative in all relative positions of said disks.

7. A grinding apparatus as claimed in claim 1 wherein:

said mounting means comprises flat bearing means enabling said first disk to be moved parallel to said second disk between said first position and said second position, the axes of said disks being aligned in said first position and being parallel in said second position.

8. A grinding apparatus as claimed in claim 7 wherein:

said hopper means include an outlet extension having a flat plate extending around the bottom thereof, said inlet means comprises a centrally located opening extending through said first disk, said opening being located underneath said extension, said first disk having a flat surface located adjacent to said flat plate and including seal means for forming a seal located between said flat plate and said flat surface.

9. A grinding apparatus as claimed in claim 7 including:

housing means for receiving ground material located around the exteriors of said first and second disks, a spout for conveying ground material from said housing means connected to the exterior of said housing means so as to extend outward therefrom, seal means connecting said disks on said housing means so as to close off the interior of said housing means around the peripheries of said disks, said seal means being operative in all relative positions of said disks.

10. A grinding apparatus as claimed in claim 1 wherein:

said mounting means comprises flat bearing means enabling said first disk to be moved parallel to said second disk between said first position and said second position, the axes of said disks being aligned in said first position and being parallel in said second position, said hopper means include an outlet extension having a flat plate extending around the bottom thereof, said inlet means comprises a centrally located opening extending through said first disk, said opening being located underneath said extension, said first disk having a flat surface located adjacent to said flat plate and including seal means for forming a seal located between said flat plate and said flat surface, housing means for receiving ground material located around the exteriors of said first and second disks, a spout for conveying ground material from said housing means connected to the exterior of said housing means so as to extend outward therefrom, seal means connecting said disks on said housing means so as to close off the interior of said housing means around the peripheries of said disks, said seal means being operative in all relative positions of said disks.

11. A grinding apparatus which comprises:

a machine housing, a motor means for supplying power mounted within said housing, a retainer housing located within said machine housing, said retainer housing having a hollow interior, a rotatable grinding disk located within said retainer housing, a shaft attached to said rotatable disk and extending therefrom through said retainer housing, said shaft being connected to said motor means so as to be driven thereby, a spout formed on said retainer housing and extending from the interior of said retainer housing to the exterior of said machine housing, a body movably mounted on said retainer housing so as to be movable with respect to said retainer housing, a non-rotating grinding disk mounted on said body adjacent to said rotatable grinding disk, said grinding disks having opposed grinding surfaces and hollow interiors, said hollow interiors facing one another, said body and said non-movable grinding disk both having openings extending therethrough, said openings being centrally located on said body and said non-rotatable grinding disk and being in communication with one another, cooperating means mounted on said machine housing and said body for moving said grinding disks with respect to one another between a first position in which said grinding disks have a common axis and in which the grinding surfaces of said grinding disks are parallel to one another, and a second position different from said first position, sealing means located between said body and retainer housing, said sealing means being capable of forming a seal between said body and said retainer housing in all positions of said body relative to said retainer housing, a hopper mounted on said machine housing, said hopper having an extension leading to said opening in said body, said hopper being located so that material can flow from said hopper through said extension and said openings to between said grinding disks.

12. A grinding apparatus as claimed in claim 11 wherein:

said retainer housing is located so as to be supported on said shaft, and is held against rotation with said shaft by engagement of said spout with said machine housing.

13. A grinding apparatus as claimed in claim 11 wherein:

both of said grinding disks include projection means extending into the interiors thereof for conveying material from within the interiors of said disks toward said grinding surfaces and for breaking up such material.

14. A grinding apparatus as claimed in claim 11 wherein:

said body is pivotally mounted upon said retainer housing.

15. A grinding apparatus as claimed in claim 14 wherein:

said cooperating means comprise cam means consisting of a cam and a cam follower, one of said parts of said cam means being mounted on said machine housing, the other of said parts of said cam means being mounted on said body, said parts of said cam means engaging one another.

16. A grinding apparatus as claimed in claim 11 wherein:

said retainer housing is located so as to be supported on said shaft, and is held against rotation with said shaft by engagement of said spout with said machine housing, both of said grinding disks include projection means extending into the interiors thereof for conveying material from within the interiors of said disks toward said grinding surfaces and for breaking up such material, said body is pivotally mounted upon said retainer housing, said cooperating means comprise cam means consisting of a cam and a cam follower, one of said parts of said cam means being mounted on said machine housing, the other of said parts of said cam means being mounted on said body, said parts of said cam means engaging one another.

17. A grinding apparatus as claimed in claim 11 wherein:

said body is mounted so as to be capable of being linearly moved in a plane transverse to the axis of said rotatable grinding disk.

18. A grinding apparatus as claimed in claim 11 wherein:

said retainer housing is located so as to be supported on said shaft, and is held against rotation with said shaft by engagement of said spout with said machine housing, both of said grinding disks include projection means extending into the interiors thereof for conveying material from within the interiors of said disks toward said grinding surfaces and for breaking up such material, said body is mounted so as to be capable of being linearly moved in a plane transverse to the axis of said rotatable grinding disk.

* * * * *

UNITED STATES PATENT OFFICE
CERTIFICATE OF CORRECTION

PATENT NO. : 3,977,612
DATED : AUGUST 31, 1976
INVENTOR(S) : LESTER BROWN and PAUL M. MOSKOWITZ It is certified that error appears in the above-identified patent and that said Letters Patent are hereby corrected as shown below:

Column 3, line 3, "these" should read --there--.

Column 4, line 8, "lower assembly 40" should read --lower assembly 44--.

Column 4, line 30, "though" should read --through--.

Column 4, line 35, "in includes" should read --it includes--.

Column 4, line 55, "hoper" should be spelled --hopper--.

Column 5, line 13, "though" should read --through--.

Column 6, line 3, "apparatus 10" should read --apparatus 200--.

Column 6, line 29, "though" should read --through--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*